US008403141B2

(12) United States Patent
Williams et al.

(10) Patent No.: US 8,403,141 B2
(45) **Date of Patent: *Mar. 26, 2013**

(54) TOOL BAG WITH SECURE-POCKET CONFIGURATION

(75) Inventors: Matthew G. Williams, Lighthouse Point, FL (US); Terrence P. Kinskey, Alpharetta, GA (US)

(73) Assignee: LF Centennial Limited, Tortola (VG)

( * ) Notice: Subject to any disclaimer, the term of this patent is extended or adjusted under 35 U.S.C. 154(b) by 0 days.

This patent is subject to a terminal disclaimer.

(21) Appl. No.: 12/607,842

(22) Filed: Oct. 28, 2009

(65) Prior Publication Data

US 2010/0133304 A1 Jun. 3, 2010

Related U.S. Application Data

(60) Provisional application No. 61/109,116, filed on Oct. 28, 2008.

(51) Int. Cl.
*B65D 85/28* (2006.01)

(52) U.S. Cl. ..... 206/372; 190/124

(58) Field of Classification Search ..... 206/372, 206/280, 286, 373–376, 570, 575–576, 561; 190/101–102, 109–111, 3–7, 24; 211/18, 211/27, 35, 41.15, 70.1, 119.12, 205, 88.01; 217/28–30, 32, 57, 2, 7; 248/552; 220/560.03, 220/564, 3.3–3.4, 3.9, 532–533, 529
See application file for complete search history.

(56) References Cited

U.S. PATENT DOCUMENTS 2,911,024 A * 11/1959 Miceli ..... 150/113
2,945,732 A 7/1960 Edmondson, Jr.
2,986,245 A 5/1961 Tuttle
3,057,508 A * 10/1962 Kimbrough, Jr. ..... 220/318
4,346,813 A 8/1982 Cho et al.
4,389,133 A 6/1983 Oberst
4,834,262 A 5/1989 Reed
5,176,281 A 1/1993 Fiore
5,265,993 A * 11/1993 Wayne ..... 410/129
(Continued)

FOREIGN PATENT DOCUMENTS

JP 05-319438 A 12/1993

OTHER PUBLICATIONS

International Search Report and Written Opinion of the International Searching Authority for International application No. PCT/US2009/062372; Korean Intellectual Property Office, search and opinion completed May 19, 2010.

*Primary Examiner* — Mickey Yu
*Assistant Examiner* — Rafael Ortiz
(74) *Attorney, Agent, or Firm* — Duane Morris LLP; J. Rodman Steele, Jr.; Gregory M. Lefkowitz

(57) ABSTRACT

A tool bag including a tool bag body having a surface with a high-density, secure-storage pocket is disclosed. The high-density, secure-storage pocket is formed from a reinforcing sheet, a base fabric sheet over the reinforcing sheet, a primary pocket layer over the base fabric sheet, a primary elastic retention strip over the primary pocket layer, and a plurality of vertically-oriented attachment regions. The base fabric sheet, the primary pocket layer and the primary retention strip are attached together by the vertically-oriented attachment regions. The base fabric material and said primary pocket layer are attached along the lower edges of each. The vertically-oriented attachment regions can be separated such that a space between the base fabric sheet and primary pocket layer between adjacent vertically-oriented attachment regions defines a primary high-density, secure-storage pocket. The primary elastic retention strip can extend horizontally and proximate to an upper edge of the primary pocket layer.

20 Claims, 15 Drawing Sheets

U.S. PATENT DOCUMENTS

| | | | | |
|---|---|---|---|---|
| 5,423,404 | A * | 6/1995 | Shaw | 190/102 |
| 6,085,902 | A * | 7/2000 | Fang | 206/373 |
| 6,126,003 | A * | 10/2000 | Brouard | 206/372 |
| D440,401 | S * | 4/2001 | Pauser et al. | D3/276 |
| 6,571,998 | B2 * | 6/2003 | Godshaw et al. | 224/607 |
| 6,913,386 | B2 | 7/2005 | Maher et al. | |
| 6,945,442 | B2 | 9/2005 | Godshaw et al. | |
| 7,150,345 | B2 | 12/2006 | Redzisz | |
| 7,243,793 | B2 | 7/2007 | Ho | |
| 7,467,730 | B2 | 12/2008 | Manke et al. | |
| 7,604,103 | B2 | 10/2009 | Hamlin | |
| 2001/0019056 | A1 | 9/2001 | Rosenfeldt | |
| 2001/0037923 | A1 | 11/2001 | Godshaw | |
| 2004/0065573 | A1 | 4/2004 | Brouard | |
| 2004/0178100 | A1 | 9/2004 | Ho | |
| 2005/0167306 | A1 * | 8/2005 | Ho | 206/373 |
| 2005/0189388 | A1 * | 9/2005 | Godshaw et al. | 224/607 |
| 2006/0037881 | A1 * | 2/2006 | Redzisz et al. | 206/373 |
| 2006/0070901 | A1 | 4/2006 | Adams et al. | |
| 2006/0219587 | A1 * | 10/2006 | Redzisz et al. | 206/373 |
| 2007/0103892 | A1 * | 5/2007 | McDaniel et al. | 362/119 |
| 2007/0137958 | A1 * | 6/2007 | Hamlin | 190/109 |
| 2008/0035509 | A1 * | 2/2008 | Redzisz | 206/373 |
| 2008/0099355 | A1 | 5/2008 | Bakker | |
| 2008/0128428 | A1 | 6/2008 | Beckerman | |
| 2008/0169739 | A1 * | 7/2008 | Goldenberg | 312/244 |

* cited by examiner

TOOL BAG WITH SECURE-POCKET CONFIGURATION

CROSS-REFERENCE TO RELATED APPLICATIONS

This application claims priority to U.S. Provisional Application Ser. No. 61/109,116 entitled "Tool Bag," filed Oct. 28, 2008, the entirety of which is hereby incorporated by reference.

FIELD OF THE INVENTION

The present invention relates generally to the field of bags, and more particularly to a multi-function tool bag that has a secure-pocket configuration.

BACKGROUND

Tool carriers are known to be useful for workers needing to carry a group of tools to and from a work site for a specific job. Although tool carriers have historically been made of metal, more recently, fabric covered tool carriers have become popular. Exemplary fabric covered prior art tool carriers having pockets include those disclosed in U.S. Pat. Nos. 6,823,992; 6,991,104; 7,314,133 and 7,314,134. While these tool carriers and others of the prior art are useful in some instances, there are still numerous deficiencies and the potential for more useful tool carriers and tool carrier features.

SUMMARY OF THE INVENTION

A tool bag comprising a tool bag body having a surface that includes a high-density, secure-storage pocket. The high-density, secure-storage pocket can include a reinforcing sheet, a base fabric sheet over the reinforcing sheet, a primary pocket layer over the base fabric sheet, a primary elastic retention strip over the primary pocket layer. The base fabric sheet, the primary pocket layer and the primary retention strip can be attached together by a plurality of discrete vertically-oriented attachment regions. The vertically-oriented attachment regions can be separated such that a space between the base fabric sheet and primary pocket layer between adjacent vertically-oriented attachment regions defines a primary high-density, secure-storage pocket. The base fabric material and the primary pocket layer can be attached along lower edges of each. The primary elastic retention strip can extend horizontally and proximate to an upper edge of the primary pocket layer The plurality of vertically-oriented attachment regions can be locally reinforced proximate an upper edge of the primary pocket layer, proximate the elastic retention strip, or both. The plurality of vertically-oriented attachment regions can attach the reinforcing sheet, the base fabric sheet, the primary pocket layer and the primary retention strip together.

The tool bag body can be formed from a base with a first endwall attached as a first end region of the base and a second endwall attached at a second end region of the base opposite the first end. The tool bag can include a tool wall extending longitudinally and attached to the first endwall and the second endwall. The tool wall can be located intermediate side edges of the base and the tool wall can include the high-density, secure-storage pocket.

The tool bag can include at least two of the high-density, secure-storage pockets. The high-density, secure storage pockets can be arranged on opposite faces of a wall of the tool bag, e.g., the tool wall. The high-density, secure-storage pocket can include a plurality of high-density, secure-storage pockets. In such an embodiment, the reinforcing sheet, the base fabric sheet, the primary pocket layer, and the primary elastic retention strip can be continuous across the plurality of high-density, secure-storage pockets.

The high-density, secure-storage pockets can also include an outer pocket layer over the primary pocket layer and an outer elastic retention strip over the outer pocket layer. The outer elastic retention strip can extend horizontally and proximate to an upper edge of the outer pocket layer. The high-density, secure-storage pockets can also include a plurality of vertically-oriented, outer attachment regions where the base fabric sheet, the primary pocket layer, the primary elastic retention strip, the outer pocket layer, the outer retention strip, and optionally the reinforcing sheet, are attached together. The base fabric material, the primary pocket layer and the outer pocket layer can be attached along lower edges of each. The vertically-oriented, outer attachment regions can be separated such that an area between the primary pocket layer and the outer pocket layer between adjacent vertically-oriented, outer attachment regions defines an outer high-density, secure-storage pocket. The outer pocket layer and said primary elastic retention strip do not overlap.

The plurality of vertically-oriented, outer attachment regions can be locally reinforced proximate an upper edge of the outer pocket layer, proximate the outer elastic retention strip, or both. In some embodiments, there can be fewer of the vertically-oriented, outer attachment regions than there are vertically-oriented attachment regions. This will result in a configuration where the outer pockets are wider than the primary pockets.

The high-density, secure-storage pocket can include a plurality of high-density, secure-storage pockets with the reinforcing sheet, the base fabric sheet, the primary pocket layer, the primary elastic retention strip, the outer pocket layer, and the outer elastic retention strip being continuous across the plurality of high-density, secure-storage pockets. The tool bag can include two of the plurality of high-density, secure-storage pockets, with each of the plurality of high-density, secure storage pockets arranged on opposite faces of a wall of the tool bag.

The tool bag can also include a first sidewall attached to a side of the tool bag body and a second sidewall attached to a second side of the tool bag body opposite the first sidewall. Both the first and second sidewall can be releasably attached to opposite sides of the first endwall and releasably attached to opposite sides of the second endwall. The second sidewall can include a sidewall section flexibly joined to a cover section. The sidewall section can be releasably attached to vertical portions of the first endwall and the second endwall and the removable cover can be removably attachable to a top portion of the first and second endwalls.

The tool bag can include a handle rotatably attached to a first handle opening in an upper portion of the first endwall and a second handle opening in an upper portion of the second endwall. The handle can include first and second base mating end portions within the handle openings and terminating facing an interior of the tool bag body. The base mating end portions can include an outer positioning device and an inner positioning device to limit longitudinal movement of the handle. The inner and outer positioning devices can be arranged on opposite sides of each handle opening.

The inner positioning device can include a friction adjuster. The friction adjuster can include a loading ring and a deformable washer sandwiched between the loading ring and the flange portion on the inside surface of the endwall. The loading ring can be attached to the base mating end portions for adjustable application of loading ring pressure against the deformable washer.

The tool bag can also include a tool wall attached to the first endwall, and the second endwall, and at least one bracket. Each of the brackets can include two legs extending perpendicular to one another. The first endwall can include a rigid, stabilizing sheet and the tool wall can include a rigid, stabilizing member extending longitudinally along the length of the tool bag. The first leg of a first bracket can be attached to the first endwall and a second leg of the first bracket can be attached to a first end region of the, stabilizing element.

These and other features, objects and advantages of the present invention will become more apparent to one skilled in the art from the following description and claims when read in light of the accompanying drawings.

DETAILED DESCRIPTION

As shown in FIGS. 1-15, a tool bag 10 with a convertible lid 24, a rotatable handle 26, and a strip of high-density, secure-storage pockets is disclosed. The tool bag 10 is configured to hold a variety of tools for easy storage and easy access when working on a project. The tool bag 10 is also configured to easily convert between a closed tool bag, an open top tool bag, and an open top tool bag that provides easy access to tools and hardware contained therein. The tool bag 10 also includes a rotatable handle 26 having a robust configuration that is capable of handling heavy loads within the tool bag 10.

Figure 8:
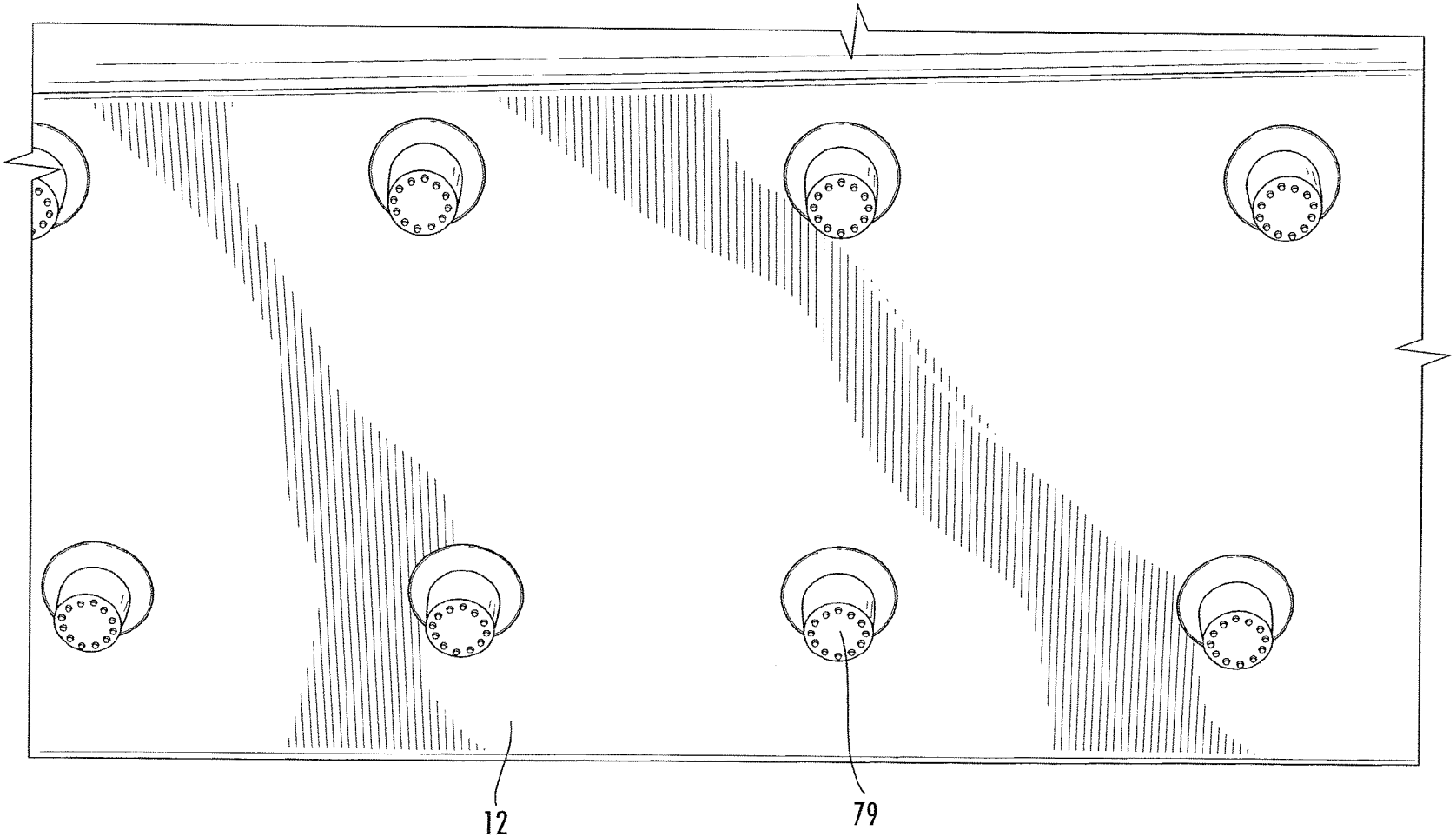
FIG. 8 is a bottom view of the tool bag.
Figure 9:
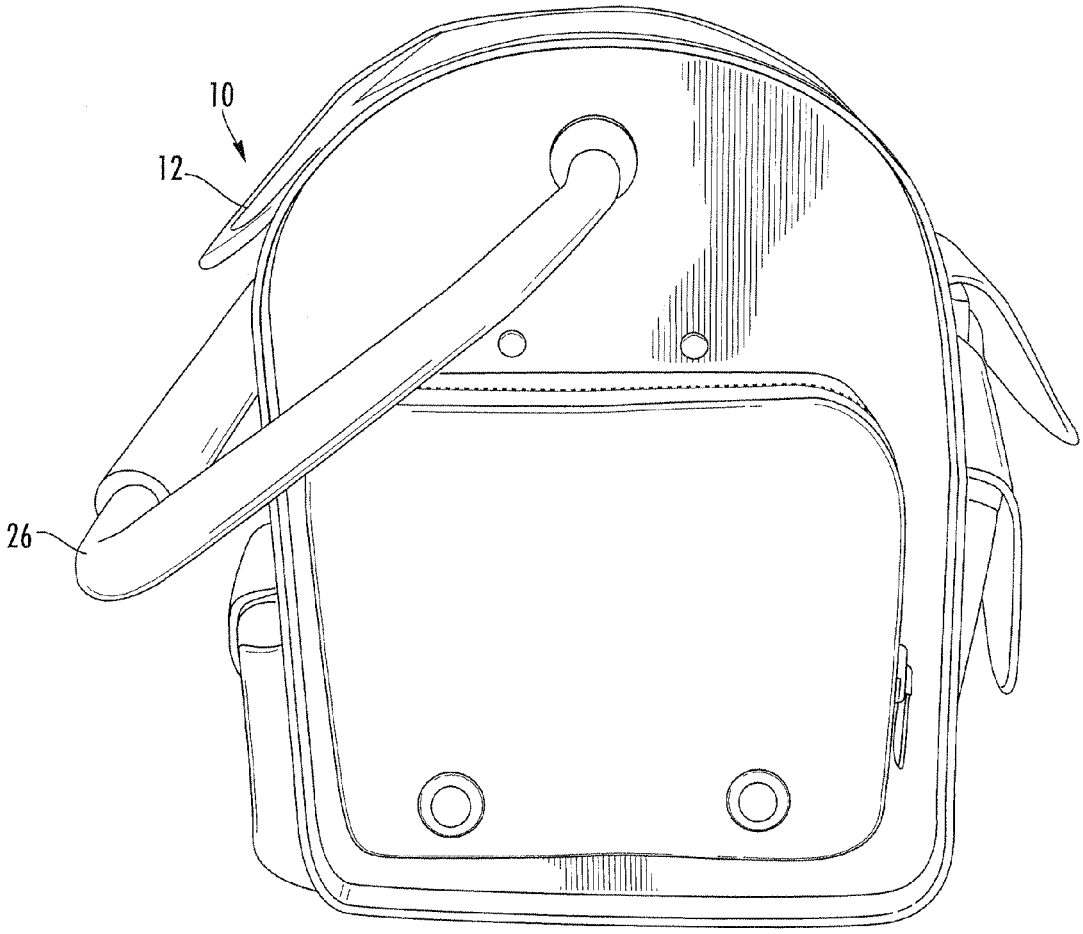
FIG. 9 is a side view of the tool bag.
Figure 10:
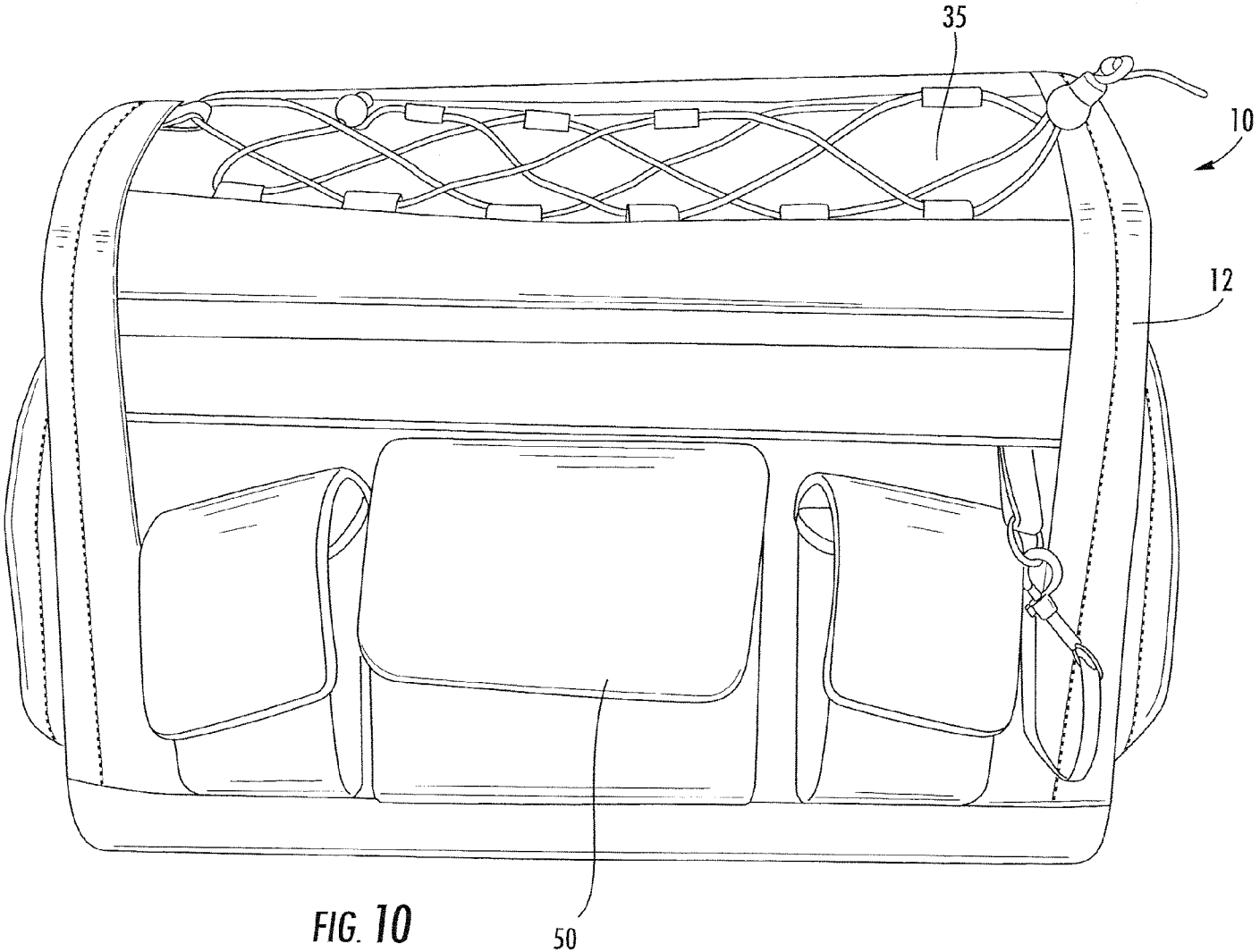
FIG. 10 is a rear view of the tool bag.

The tool bag 10 may be formed from a tool bag body 12. The tool bag body 12 can be formed from a base 14 with a first endwall 16 attached at a first end region 18 of the base 14 and a second endwall 20 attached to a second end region 22 of the base opposite the first end region 18. An underside of the base 14 can include a plurality of feet 79, as is shown in FIG. 8. The feet 79 can be made of rubber or other suitable material. The feet can be attached to the base 14 in any appropriate way, including, for example, stitching, adhesives or fasteners. The feet 79 can be arranged on the base 14 in any suitable manner. The feet 79 can minimize contact between the base 14 of the tool bag 10 and a surface upon which the tool bag 10 is set, which can reduce wear.

A first sidewall 28 can be flexibly attached to a first lateral portion of the tool bag body 12 and be releasably attachable to the first endwall 16 and releasably attachable to the second endwall 20. A second sidewall 30 can be flexibly attached to a second lateral portion of the tool bag body opposite the first lateral portion, with the second sidewall 30 comprising a sidewall section 32 flexibly joined to a cover section 34. The releasably attachable functionality described herein, can be achieved using any number of device, including, but not limited to, zippers and hook and loop materials. In one embodiment, the first and/or second sidewalls 28, 30 can be pivotably attached to the lateral portions of the tool bag body 12. The lateral portions to which the sidewalls 28, 30 are attached can be lateral portions of the base 14 or fixed sidewall portions attached to the first and second endwalls 16, 20. The fixed portion can be anchored to the first and second endwalls 16, 20.

The second sidewall 30 can be releasably attachable to the first endwall 16 and releasably attachable to the second endwall 20. The sidewall section 32 can be releasably attachable to vertical portions of the first endwall 16 and the second endwall 20. The removable cover can be removably attachable to an upper portion 31 of the first and second endwalls 16, 20. As used herein, "upper portion" is used to refer to the upper half of a member.

The first and second endwalls 16, 20 can include an endwall reinforcing member 65 covered with a durable cloth on both sides. The endwall reinforcing member 65 can be a plastic board, a wooden board, a combination thereof, or a similar reinforcing material. The reinforcing member 65 can be a stabilizing member such as, but not limited to, a wooden board sandwiched between two plastic boards. Materials used to make the plastic sheets or boards can include, but are not limited to, polyethylene (PE), polypropylene (PP), polystyrene (PS), polyesters, combinations thereof, and other durable polymer materials. The thickness of the reinforcing member can be such that the reinforcement board maintains a substantially planar shape when placed under an appropriate load.

As used herein, "stabilizing member" is used to refer to a member that will substantially maintain its shape against loads typically encountered during use, i.e., is not substantially deformable under typical loads. As used herein, "reinforcing member" is used to refer to a member adding some integrity to a wall or surface that is less than that of a stabilizing member. A reinforcing member may or may not be deformable when exposed to loads typically encountered during use. Thus, the term reinforcing member encompasses all stabilizing members, whereas the term stabilizing members does not include all reinforcing members.

The cover section 34 can include a top section 35 and a closing flap 37, wherein opposite edges of the top section 34 are flexibly attached to the sidewall section 32 and the closing flap 37. The closing flap 37 can overlap with an upper portion 29 of the first sidewall 28 when the first and second sidewalls 28, 30 are in a closed position, as shown in FIGS. 1, 5, 9 and 10. The closing flap 37 can include a stabilizing element and an upper portion 29 of the first sidewall 28 can include a stabilizing element. The stabilizing elements can be contained between two layers of durable fabric. The closing flap 37 and the first sidewall 28 can be releasably attached when the first and second sidewalls 28, 30 are in a closed position.

Figure 1:
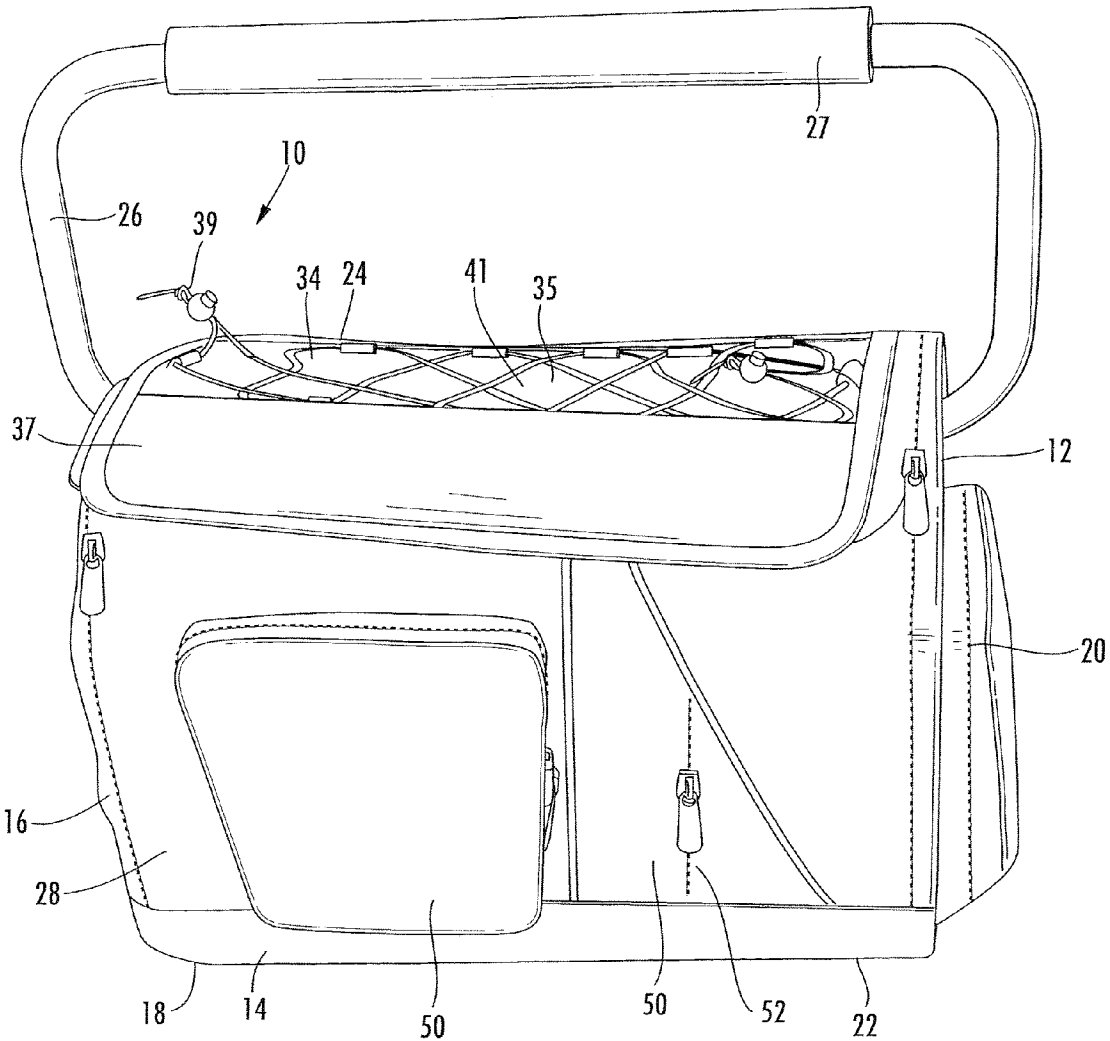
FIG. 1 is a front view of a tool bag described herein.
Figure 2:
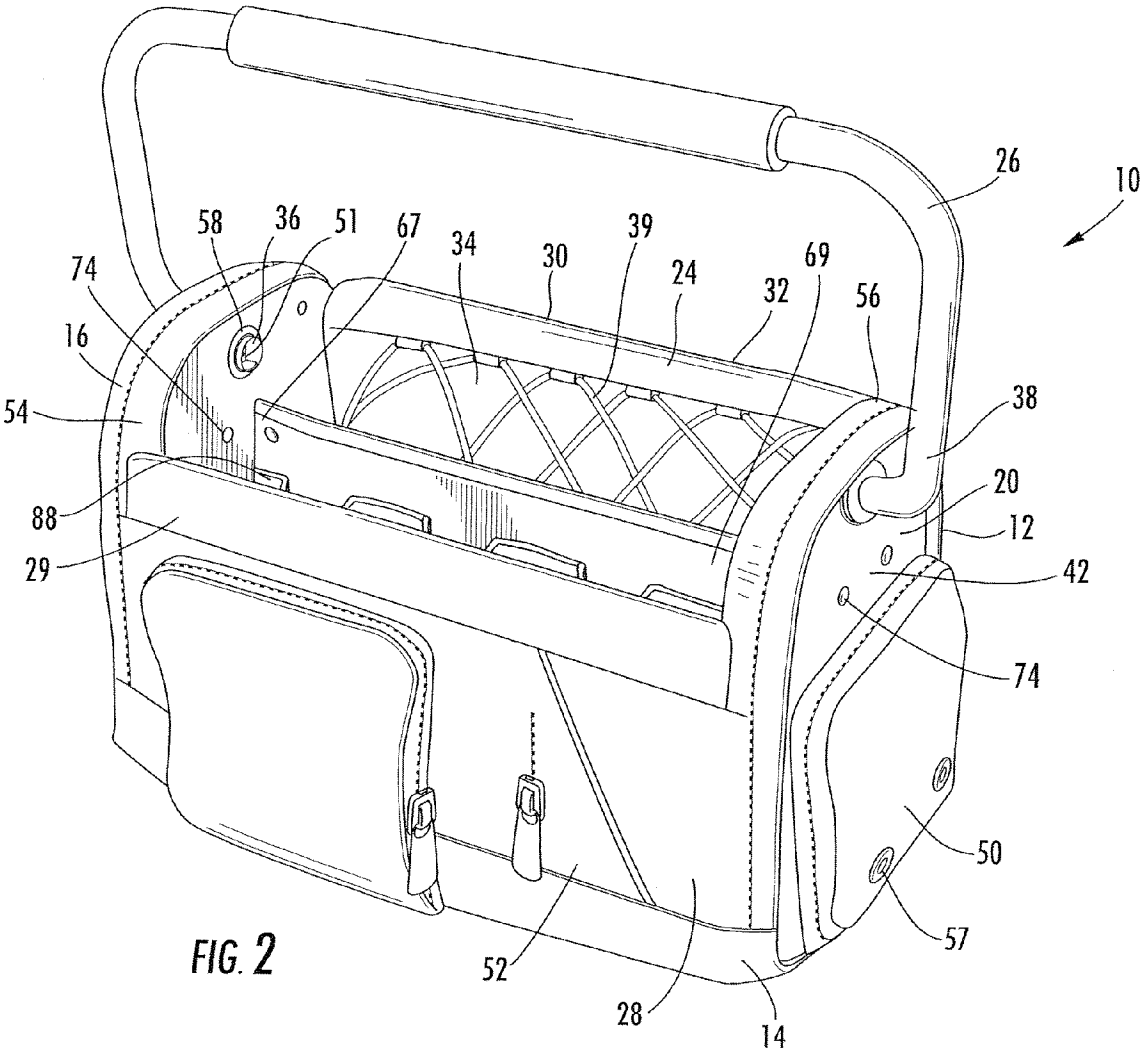
FIG. 2 is a perspective view of the tool bag described herein.
Figure 3:
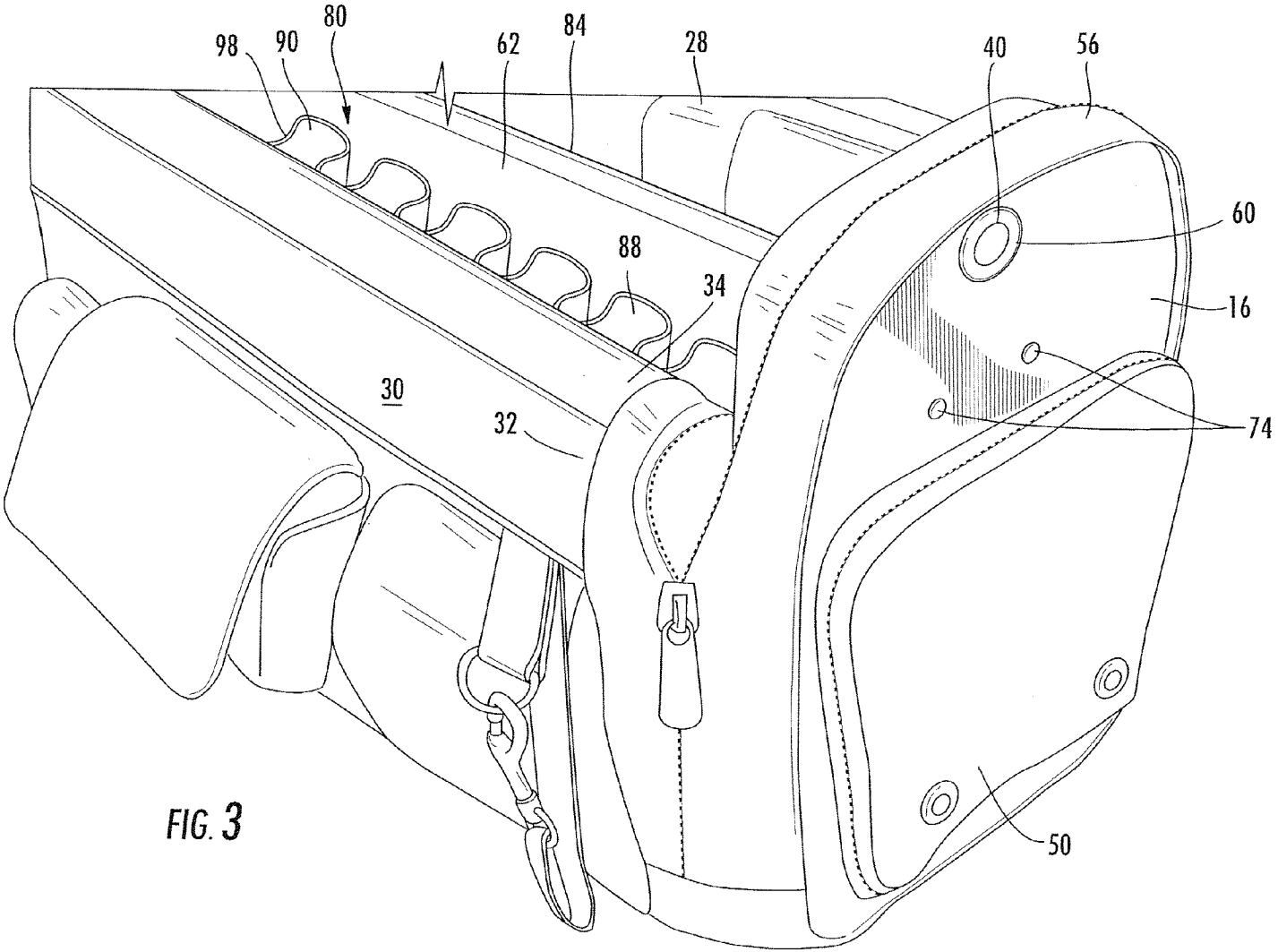
FIG. 3 is a detailed view of the second sidewall with the cover section folded inside of the tool bag body.
Figure 4:
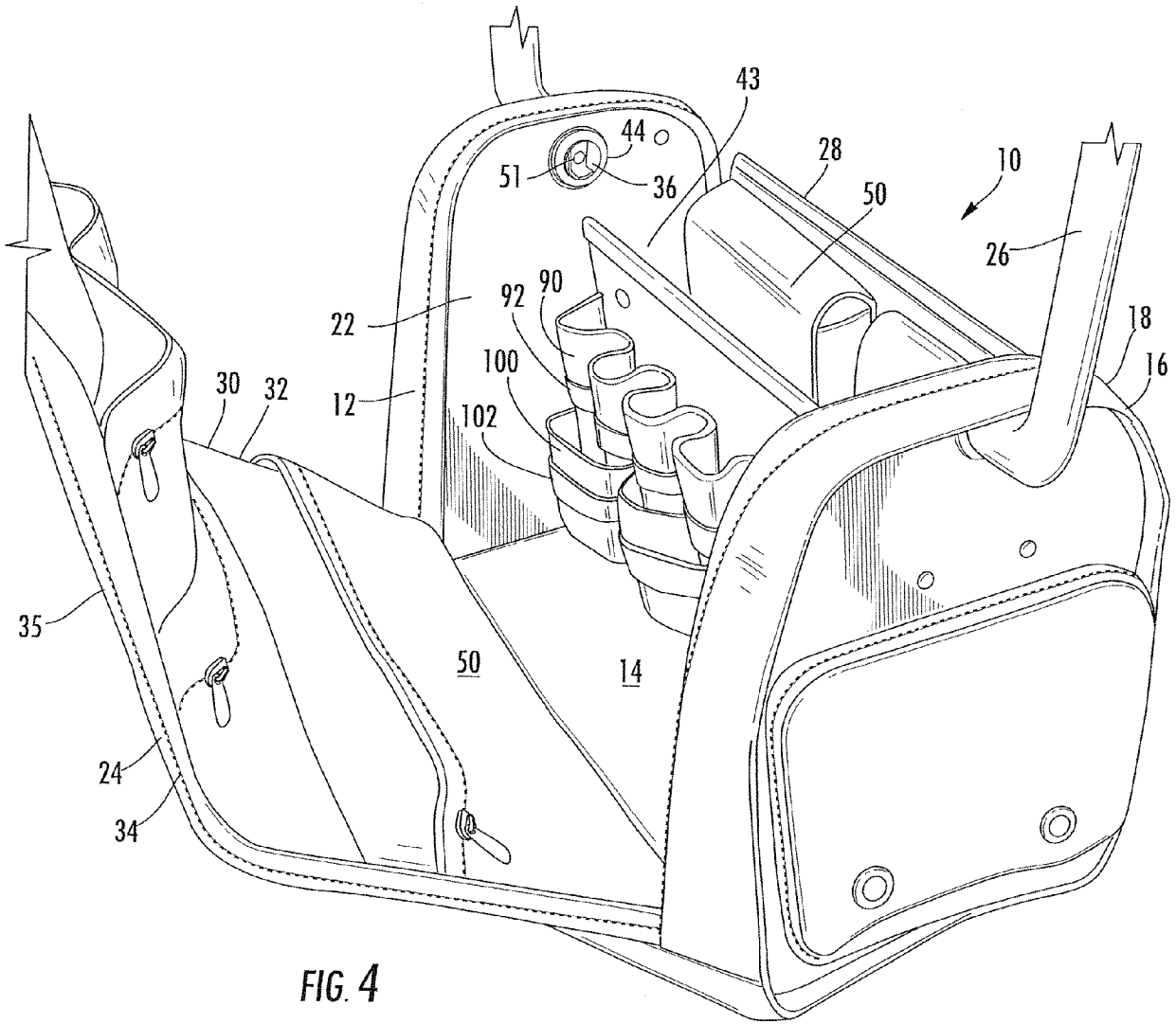
FIG. 4 is a detailed view of the second sidewall with the cover section and sidewall section opened.
Figure 5:
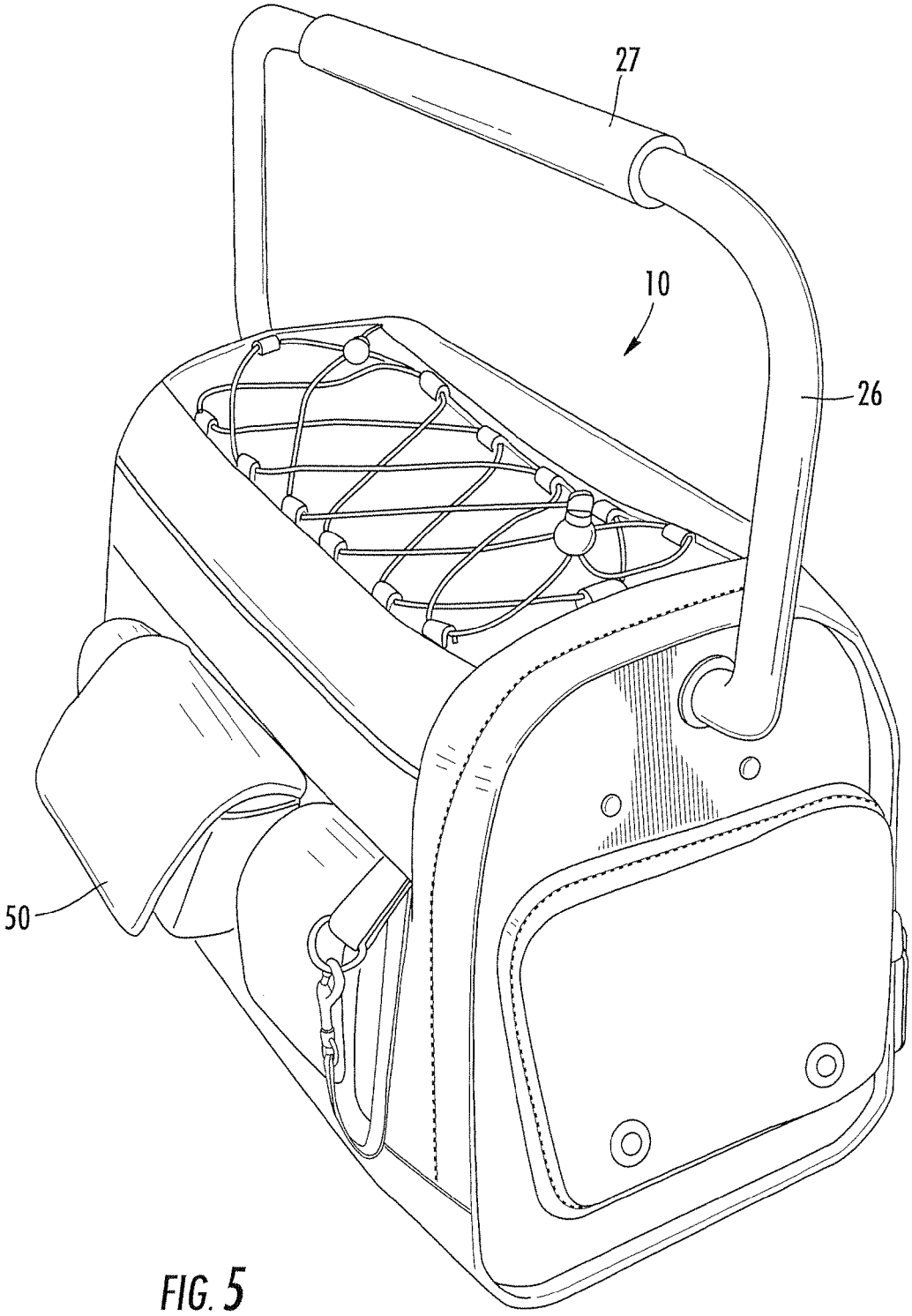
FIG. 5 is a perspective view of the tool bag with both sections of the second sidewall closed.
Figure 6:
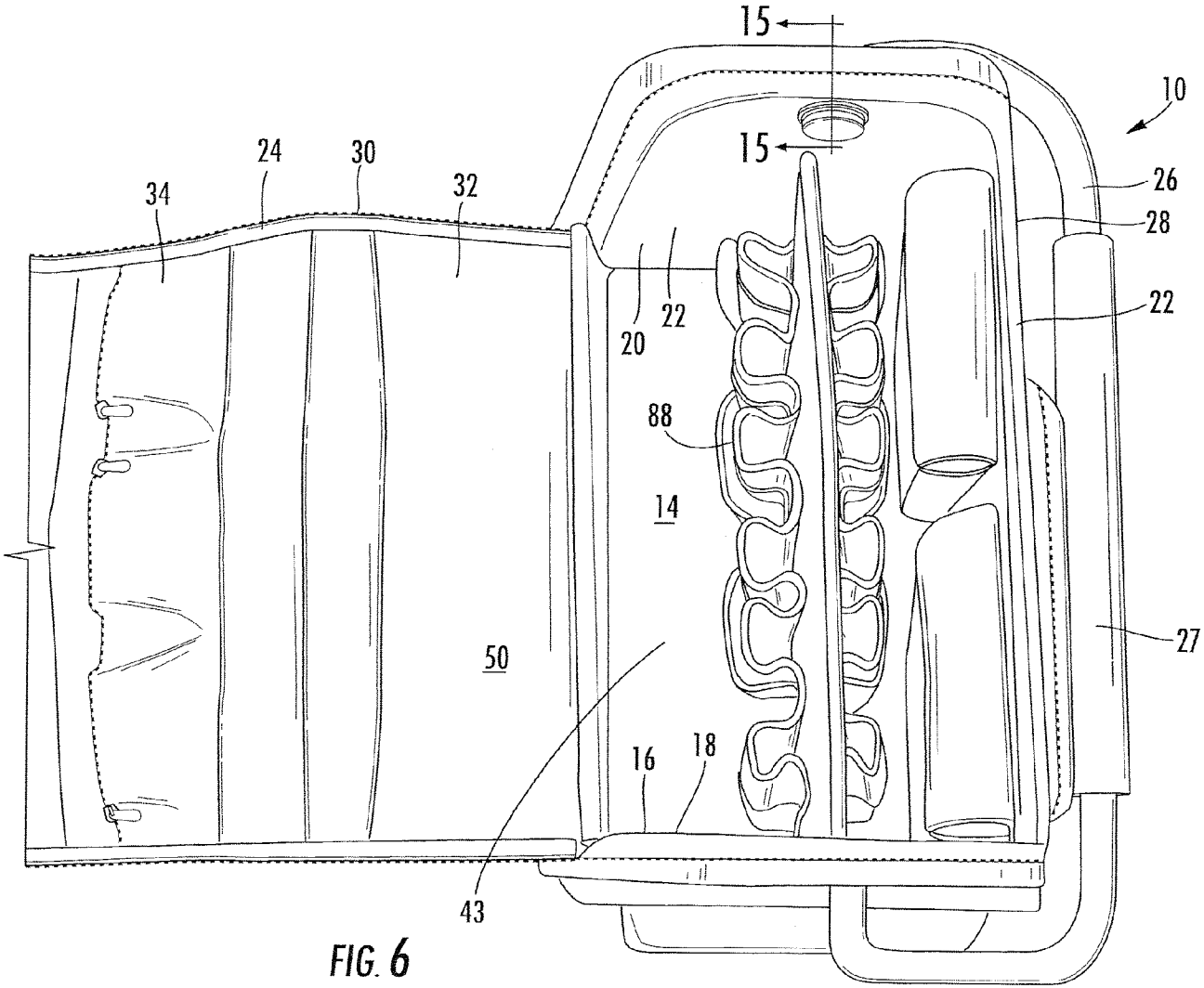
FIG. 6 is a top view of the second sidewall open.
Figure 7:
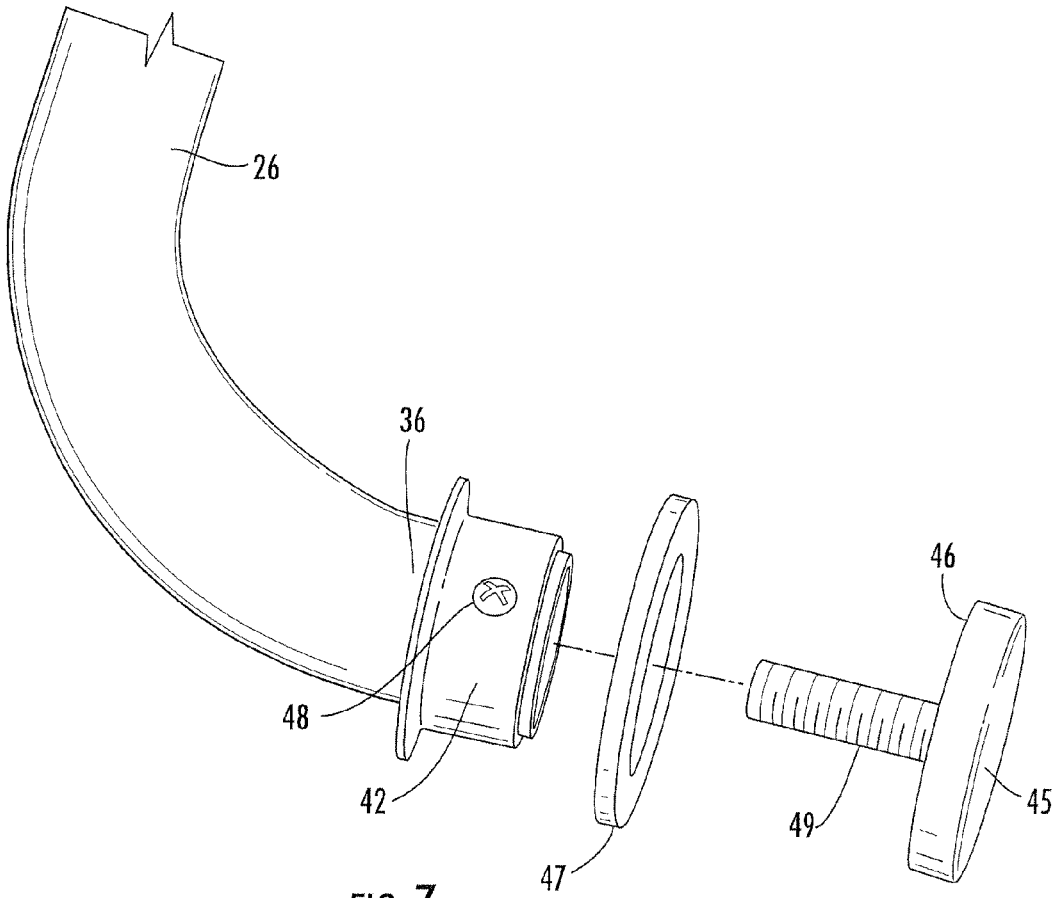
FIG. 7 is a detailed view of an end of the handle with outer and inner positioning devices.

Alternately, as shown in FIGS. 2-4 and 6, the removable cover section 34 may be positioned alongside the sidewall section 32 to create an open topped tool bag 10, thereby providing easy access into the tool bag 10 and the tools contained therein. As shown in FIGS. 1 & 2, the cover section 34 can also include an elastic cord 39, such as a bungee cord, attached to an exterior surface 41 of the top section 35 and the closing flap 37. The elastic cord 39 can bias the top section 35 and the closing flap 37 toward a planar orientation, as shown in FIGS. 2 & 6. Thus, the elastic cord 39 helps with the open topped tool bag configuration of FIGS. 2 & 3. Beneficially, the elastic cord also provides an additional surface where tools can be temporarily stored and retained.

It will be appreciated that when the releasably attached sidewalls 28, 30 are released and allowed to lay out to the sides of the tool bag body, the user will have unfettered access to the interior of the tool bag, including the compartments and pockets housed on the interior surfaces thereof. FIG. 6 shows the second sidewall 30 in such an open configuration.

The first endwall 16 can include a first reinforcing rim 54 attached to the perimeter of the first endwall 16. The first reinforcing rim 54 can be arranged perpendicular to the first endwall 16. The second endwall 20 can include a second reinforcing rim 56 attached to the perimeter of the second endwall 20. The second reinforcing rim 56 can be arranged perpendicular to the first endwall. As used herein, "perpendicular" is used to indicate that the angle between two surfaces is 90 degrees, but is also intended to include minor deviations from 90 degrees. For example, it is intended that "perpendicular" would include a range from 75 degrees and 105 degrees, or 80 degrees to 100 degrees.

As shown in the Figures, the first sidewall 28 can be releasably attached to the first reinforcing rim 54 and releasably attached to the second reinforcing rim 56. Similarly, the sidewall section 32 can be releasably attached a vertical portion of the first reinforcing rim 54 and releasably attached to a vertical portion of the second reinforcing rim 56.

Figure 12:
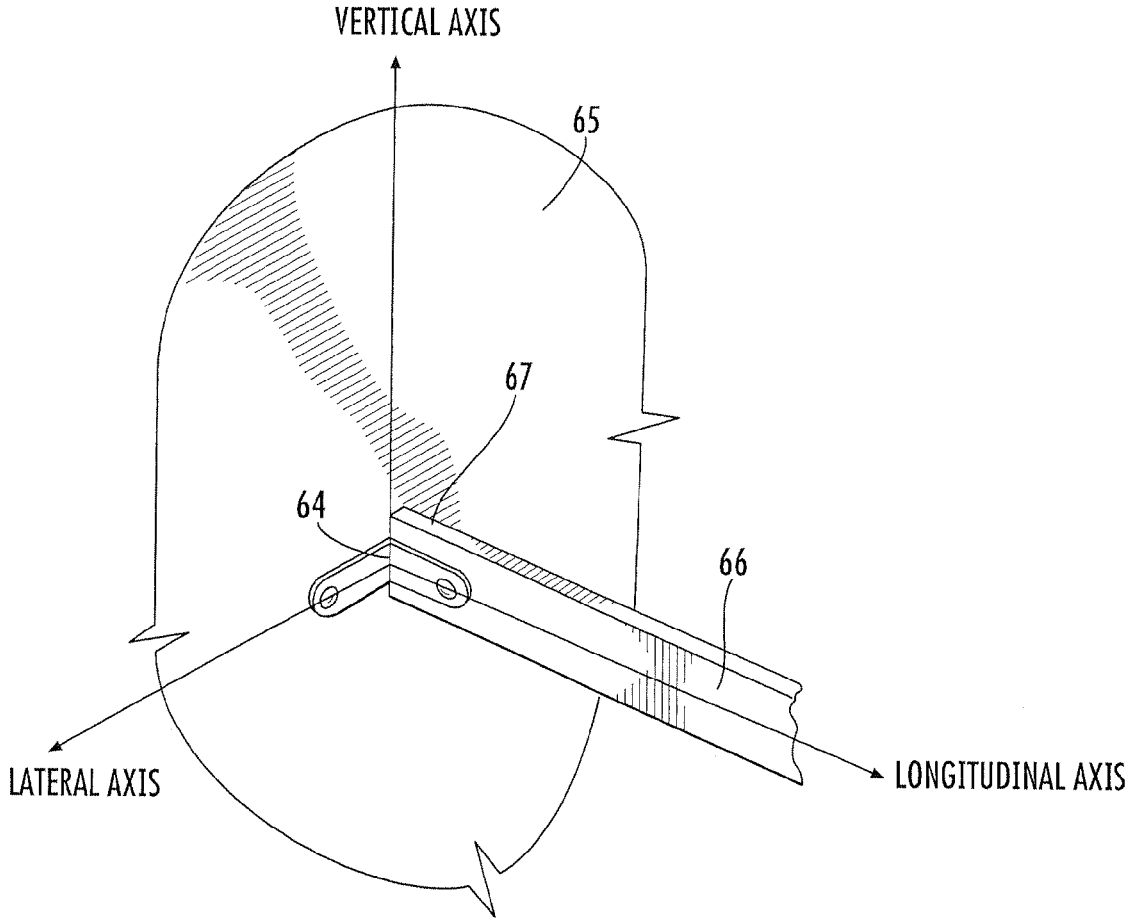
FIG. 12 is a perspective view of structural elements showing attachment of the tool wall rigid, stabilizing element to the endwall stabilizing element.

As used herein, "vertical" is used to refer to the vertical direction when the base 14 of the tool bag is placed flat on a flat surface. As used herein, "longitudinal" is used to refer to the direction extending orthogonal from the first endwall toward the second endwall. As used herein, "lateral" is used to refer to the direction extending orthogonal from the first sidewall toward the second sidewall. These axes are shown in FIG. 12. As used herein, "horizontal" is used to refer to both the lateral and longitudinal directions. Like the term perpendicular, the terms vertical, longitudinal, lateral, and horizontal are intended to include minor deviations from the directions defined herein. For example, deviations of plus or minus 15 degrees or plus or minus 10 degrees.

As shown in FIG. 1, the tool bag 10 can also include a handle 26 rotatably attached thereto. The handle 26 can have any suitable range of motion. For example, the handle 26 can rotate at least about 180 degrees on the tool bag 10. In some instances, the handle 26 can rotate from about 180 degrees to about 320 degrees on the tool bag 10. In other instances, the handle 26 can rotate from about 180 degrees to about 270 degrees on the tool bag 10. The handle 26 can be made of any suitable material, including metals and alloys, just to name a few possibilities. The handle 26 may or may not be hollow. The handle can have any suitable cross-sectional shape, including circular, oval, polygonal, rectangular or polygonal, just to name a few possibilities. The handle 26 can include first and second end portions 36, 38. The first and second end portions 36, 38 can be substantially identical to each other, or they can be different.

The handle 26 can include a grip 27 located generally centrally along the length of the handle 26. The grip 27 can be made of an appropriate material for improving a user's grip, improving pressure distribution of the tool bag load, or both. Exemplary materials for producing the grip 27 include, but are not limited to, foam, rubber, plastic, combinations thereof and other appropriate materials.

The tool bag 10 can include a first handle opening 40 in the first endwall 16. In one embodiment, the first handle opening 40 can be located in an upper portion of the first endwall 16. The tool bag 10 can include a second handle opening 40 in the second endwall 20. In one embodiment, the second handle opening 40 can be located in an upper portion of the second endwall 20. The first handle opening 40 can be substantially aligned with the second handle opening 40. The first and second handle openings 40 can have any suitable confirmation, including, for example, being generally circular.

The first handle opening 40 can be reinforced. Such reinforcement can be achieved in any suitable manner. For instance, the first handle opening 40 can be reinforced by a grommet with flange portions 58, 60 on inside and outside surfaces of the first endwall 16. The grommet can be made of metal, alloy or other suitable material. Likewise, the second handle opening 40 can be reinforced in any suitable manner. For example, the second handle opening 40 can be reinforced by a grommet with flange portions 58, 60 on inside and outside surfaces of the second endwall 16. Again, the grommet can be made of metal, alloy or other suitable material.

The first and second end portions 36, 38 can be attached to the tool bag 10 in any suitable manner. In one embodiment, the first end portion 36 and/or the second end portion 38 of the handle 26 can be received in a respective one of the handle openings 40 from the outside of the tool bag 10. In some instances, the first end portion 36 and/or the second end portion 38 can pass through the handle openings 40 and extend into an interior 43 of the tool bag body 12.

The first end portion 36 and/or the second end portion 38 can include an outer positioning device 42 to limit lateral inward movement of the handle 26 toward the interior 43 of the tool bag 10. The outer positioning device 42 can be any suitable structure that is unitary with the handle 26 or separate from the handle 26 but attached thereto. In one embodiment, the outer positioning device 42 can be a flanged collar. The outer positioning device 42 can be secured to the handle 26 in any suitable manner, including by fasteners (such as screw 48), welding, and/or adhesives. The first and/or second end portions 36, 28 can include an inner positioning device 44 to limit lateral outward movement of the handle 26 away from the interior 43 of the tool bag 10. The inner and outer positioning devices 42, 44 can be arranged on opposite sides of each handle opening 40.

Figure 15:
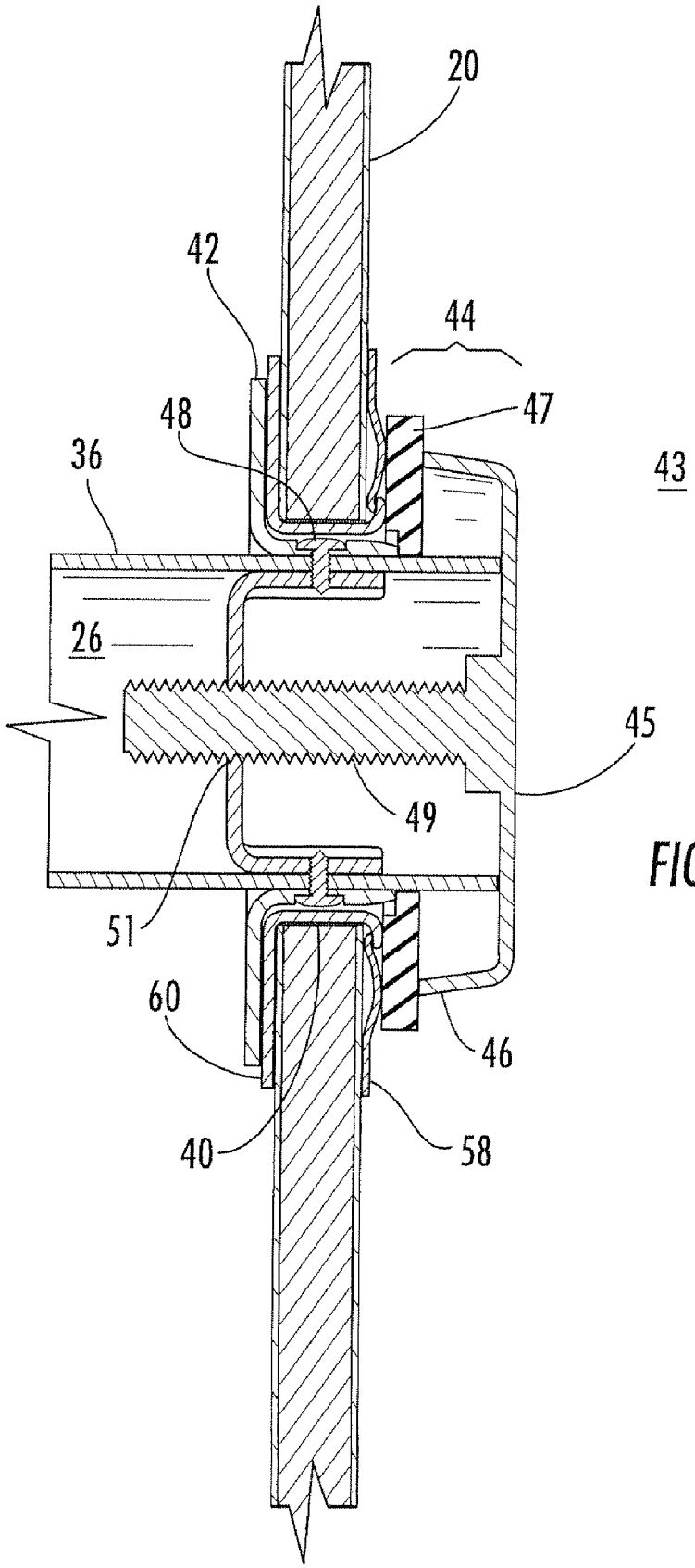
FIG. 15 is a cross-sectional view of an end of the handle and the longitudinal positioning devices, including the end-cap assembly and the outer positioning device, taken along cut line 15-15 of FIG. 6.

As shown in FIG. 15, the inner positioning device 44 can include an endcap assembly 45. The endcap assembly 45 can include a cap 46 and a deformable washer 47 sandwiched between the cap 46 and the inner flange portion 58 of the handle opening 40. The cap 45 can be attached to the end portions 36, 38 of the handle 26 for adjustable application of pressure against the deformable washer 47. The cap 46 can include a threaded protrusion 49 and the end portions 36, 38 can include a threaded portion 51 for threadably engaging the protrusion 49. The endcap assemblies 45 can be used to increase the ease with which the handle 26 rotates or to maintain the handle 26 in a particular orientation. The endcap 45 assembly also makes the handle easily removeable.

The handle 26 can be generally C-shaped. As used herein, "generally C-shaped" is used to refer to a shape that can include a shape having two separated ends, where the shape would become continuous if the ends were extended in the general direction of the shape where the ends terminate. For example, the handle 26 shown in FIG. 1 would have be a complete rectangle, having with rounded corners, if the shape continued past the ends. In other words, "generally C-shaped" refers to a closed loop shape with a portion removed therefrom.

A tool wall 62 can be provided on the interior 43 of the tool bag 10. The tool wall 62 can be attached to the first endwall 16 and/or the second endwall 20, and, optionally, the base 14. The first endwall 16 and/or the second endwall 20 can include rigid, stabilizing sheets 65 covered with a durable fabric material. The tool wall 62 can also include a rigid, stabilizing element 66 extending longitudinally along the length of the tool bag 10. The element 66 can be provided in an upper region of the tool wall 62. At least one of the ends of the stabilizing element 66 can include a connector to facilitate the joining of the rigid, stabilizing element 66 to a respective one of the endwalls 16, 20, such as the rigid stabilizing sheet 65. The connector can be any suitable structure. For instance, the connector can be a bracket 64, which can be L-shaped (FIG. 11A) or T-shaped (FIG. 11B).

As shown in FIG. 12, in which the fabric facings are removed for clarity, a first leg 68 of a first bracket 64 can be rigidly attached to the first endwall 16 and a second leg 70 of the first bracket 64 can be rigidly attached to a first end region 67 of the rigid, stabilizing element 66. Alternatively or in addition, a first leg 68 of a second bracket 64 can be rigidly attached to the second endwall 20 and the second leg 70 of the second bracket 64 be rigidly attached to a second end region of the rigid, stabilizing element 66 opposite the first end 72. The second leg 70 can be substantially perpendicular to the first leg 68.

Figure 11A:
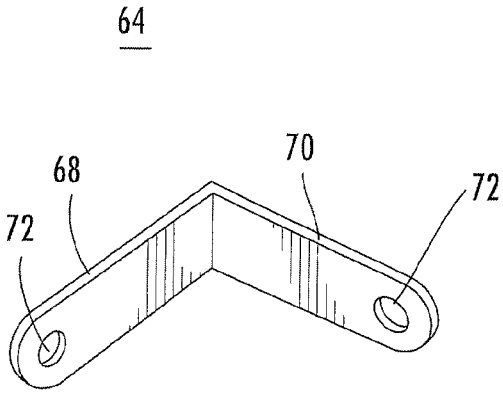
FIG. 11 is a perspective view of (A) an L-bracket, and (B) a T-bracket.
Figure 11B:
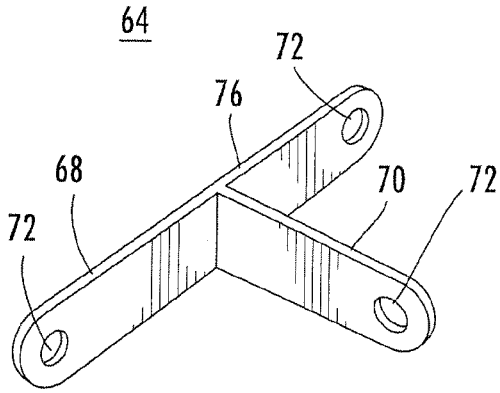

Again, as shown in FIG. 11(B), the first and/or second bracket 64 can be T-brackets comprising a main element 76, including the first leg 68 and a third leg 78. The second leg 70 of the T-bracket can extend substantially perpendicularly from an intermediate portion of the main element 76. Each end of the main element 76 of the first bracket 64 can be rigidly attached to the first endwall 16 and each end of the main element 76 of the second bracket 64 can be rigidly attached to the second endwall 20. As described above, the second leg 70 of the first bracket 64 can be rigidly attached to a first end 67 of the rigid, stabilizing element 66 and the second leg 70 of the second bracket 64 can be rigidly attached to the opposite end 69 of the rigid, stabilizing element 66.

As shown in FIGS. 11A and 11B, the distal end regions of each leg of each bracket 64 can include one or more openings 72. A fastener, such as a rivet 74 (FIG. 4) or screws, can pass through each opening 72 to rigidly attach the first and second brackets 64 to the first and second endwalls 16, 20.

Figure 13:
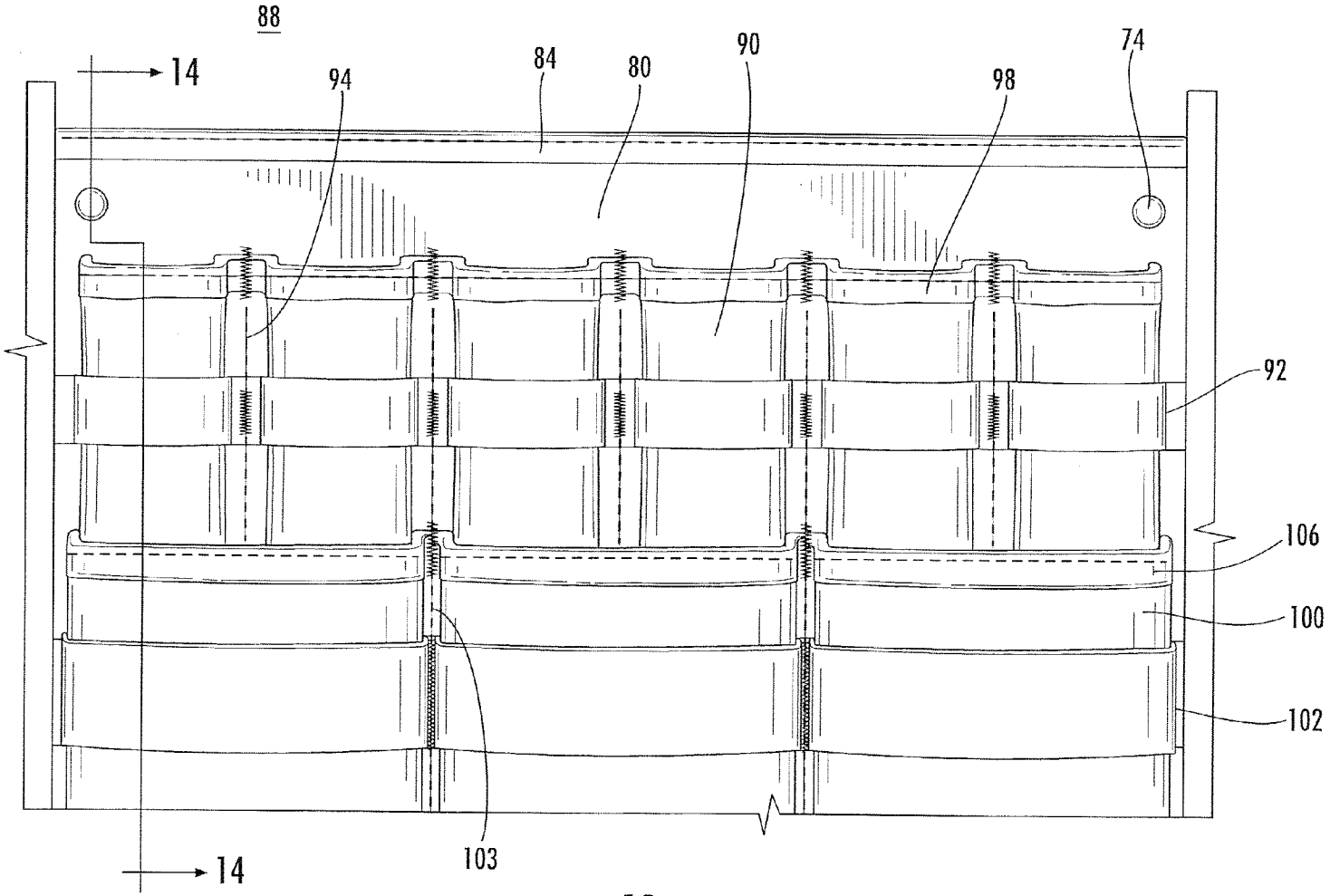
FIG. 13 is a front view of the high-density, secure-storage pocket system on a tool wall.

As shown in FIG. 13, the tool wall 62 can also include fabric facings 80 on both sides of the rigid, stabilizing element 66. The fabric facings 80 can extend along the length of the rigid, stabilizing element 66 and down toward the base 14. The fabric facings 80 can be attached to each other along edges above and below the rigid, stabilizing element 66. For example, the facings can be, but are not necessarily, attached together using bindings 84, 86.

The lower edges of the fabric facings can be attached to the base, for example, to a fabric covering comprising the base. In addition, the longitudinal edges of the fabric facings 80 can be attached to the first and second endwall 16, 20. For example, the longitudinal edges of the fabric facings 80 can be attached to a fabric facing that is part of the first or second endwall 16, 20. The tool wall 62 can also include at least one reinforcing sheet 82, such as a polypropylene sheet, disposed between the fabric facings 80. There can be at least one reinforcing sheet 82 disposed between the fabric facings 80 and on both sides of the rigid, stabilizing element 66. The fabric facings 80 and the tool wall reinforcing sheets 82 can be attached along an edge above the rigid, stabilizing element 66. The fabric facings 80 and the tool wall reinforcing sheets 82 can be attached by a binding 84.

Figure 14:
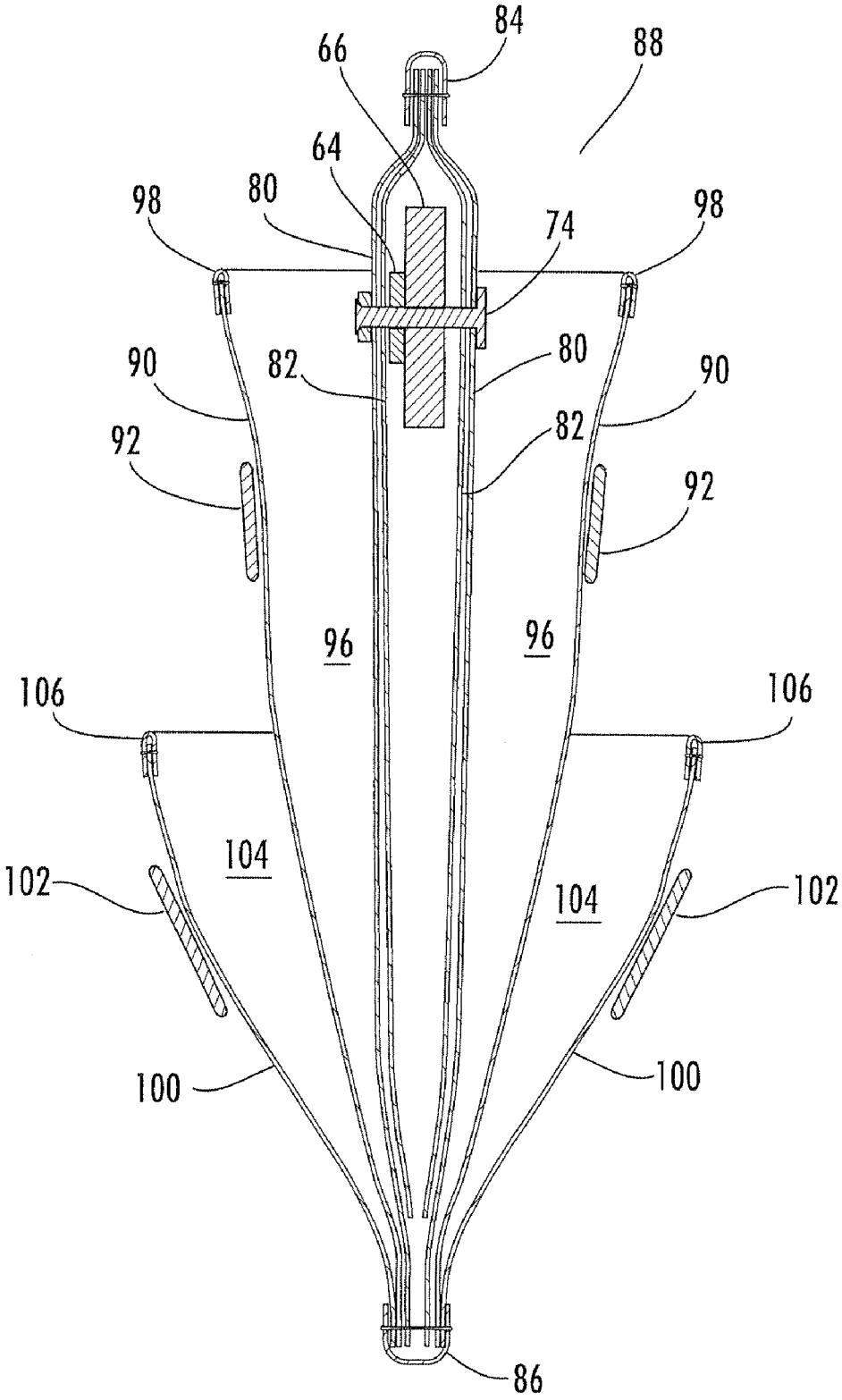
FIG. 14 is a cross-sectional view of the tool wall and high-density, secure-storage pockets taken along cut line 14-14 of FIG. 13.

As shown in FIGS. 13 & 14, the tool bag 10 can also include one or more pockets 88. The pockets 88 can be high-density, secure-storage pockets. The pockets 88 can be formed on one or more of surfaces of the tool bag 10, such as on the tool wall 62, if one is provided. The pockets 88 can be formed by attaching a primary pocket layer 90 to a surface of the tool bag 10. In one embodiment, the surface can include a reinforcing sheet 82 and a base fabric sheet 80 over the reinforcing sheet 82. The primary pocket layer 90 can be made of any suitable material, such as fabric, which may have a plastic backing.

While FIG. 13 shows a plurality of pockets 88, it will be understood that a single pocket 88 provided on a surface of the tool bag 10. When provided, the plurality of pockets 88 can be arranged in any suitable manner. For instance, the plurality of pockets 88 can be arranged in a generally strip or row along the surface. The strip can extend generally horizontally. The pockets in the strip can be identical to each other, or at least one of the pockets can be different from the other pockets in one or more respects. Further, it should be noted that pockets 88 can be provided on a plurality of surfaces of the tool bag 10. These surfaces may be internal or external surfaces of the tool bag 10.

A primary elastic retention strip 92 can be provided over the primary pocket layer 90. The primary elastic retention strip 92 can extend generally horizontally across the primary pocket layer 90. The primary elastic retention strip 92 can be proximate to an upper edge of the primary pocket layer 90. The primary elastic retention strip 92 can be formed from any material that is elastic. Examples include, but are not limited to, woven materials incorporating elastic filaments, including those sold under the brand name LYCRA®. As the pockets 88 are filled with items, the retention strip 92 can bias the pocket toward the surface, thereby providing support to the pockets 88.

The pockets 88 can also include a plurality of vertically-oriented attachment regions 94 where the base fabric sheet 80, the primary pocket layer 90, the primary retention strip 92, and optionally, the reinforcing sheet 82, are attached together along a generally vertical seam. The base fabric sheet 80 and the primary pocket layer 90 can be attached along lower edges of each, for example as part of a binding 86. The vertically-oriented attachment regions 94 can be separated such that a space 96 between the base fabric sheet 80 and primary pocket layer 90 between adjacent vertically-oriented attachment regions 94 define a primary pocket. The upper end of each pocket 88 can be open.

The pockets 88 can include a binding 98 over an upper edge of the primary pocket layer 90. As shown in FIG. 13, the plurality of vertically-oriented attachment regions 94 can be locally reinforced proximate an upper edge of the primary pocket layer 90. For example, the reinforcement can include the binding 98. The plurality of vertically-oriented attachment regions 94 can be locally reinforced proximate the primary elastic retention strip 92.

The pockets 88 can also include an outer pocket layer 100 over the primary pocket layer 90 and an outer elastic retention strip 102 over the outer pocket layer 100. The outer elastic retention strip 102 can extend generally horizontally across the outer pocket layer 100. The outer elastic retention strip 102 can be provided in a region that is and proximate to an upper edge of the outer pocket layer 100.

The plurality of vertically-oriented, outer attachment regions 103 can attach the base fabric sheet 80, the primary pocket layer 90, the primary retention strip 92, the outer pocket layer 100, the outer retention strip 102, and optionally the reinforcing sheet 82. The base fabric material 80, the primary pocket layer 90, and the outer pocket layer 100 can be attached along lower edge of each, for example using a binding 86. The vertically-oriented, outer attachment regions 103 can be separated such that a space 104 between the primary pocket layer 90 and the outer pocket layer 100 between adjacent vertically-oriented, outer attachment regions 103 defines an outer high-density, secure-storage pocket.

The outer pocket layer 100 and the primary elastic retention strip 92 can be arranged such that they do not overlap. In other words, as shown in FIGS. 13 & 14, the primary retention strip 92 can be located higher along pockets 88 than the highest extent of the outer pocket layer 100. The high-density, secure-storage pockets 88 can include a binding 106 over an upper edge of the outer pocket layer 100.

The plurality of vertically-oriented, outer attachment regions 103 can be locally reinforced proximate an upper edge of the outer pocket layer 104. For example, the reinforcement can include the binding 106. The plurality of vertically-oriented, outer attachment regions 103 can be locally reinforced proximate the outer elastic retention strip 102.

There can be fewer of the vertically-oriented, outer attachment regions 103 than there are vertically-oriented attachment regions 94. Such an arrangement results in wider outer pockets than primary pockets. Alternatively, there can be more vertically-oriented, attachment regions 94 that there are vertically-oriented, outer attachment regions 103.

The tool bag 10 can include two of the strips of pockets 88, where the strips of high-density, secure storage pockets 88 are arranged on opposite faces of a wall of the tool bag, as shown in FIG. 14.

The tool bag body 12 can also include a plurality of other pockets 50. The pockets 50 may have a plurality of sizes and shapes and be positioned on inner and outer surfaces of the tool bag body 12. As shown in FIG. 2, a pocket 50 on the second sidewall can include reinforced openings 57 to increase airflow. The foregoing is provided for purposes of illustrating, explaining, and describing embodiments of this invention. Modifications and adaptations to these embodiments will be apparent to those skilled in the art and may be made without departing from the scope or spirit of this invention.

What is claimed is:

1. A tool bag, comprising:

a tool bag body having a surface, said surface comprising a plurality of primary secure-storage pockets; and a plurality of outer secure-storage pockets, comprising an outer pocket layer over said primary secure-storage pockets, said primary secure-storage pockets, comprising:

a reinforcing sheet;

a base fabric sheet over said reinforcing sheet;

a primary pocket layer over the base fabric sheet;

a primary elastic retention strip over said primary pocket layer, said primary elastic retention strip extending horizontally; and a plurality of vertically-oriented attachment regions where said base fabric sheet, said primary pocket layer, said primary elastic retention strip are attached together, said pluralitv of outer secure-storage pockets further comprising a plurality of vertically-oriented, outer attachment regions where said base fabric sheet, said primary pocket layer, said primary elastic retention strip and said outer pocket layer arc attached together, wherein said base fabric material and said primary pocket layer are attached proximate lower edges of each, wherein said reinforcing sheet, said base fabric sheet, said primary pocket layer, and said primary elastic retention strip are continuous across said plurality of secure-storage pockets, wherein said primary elastic retention strip is positioned below an upper edge of said primary pocket layer and above an upper edge of said outer pocket layer, wherein said vertically-oriented attachment regions are separated such that spaces between the base fabric sheet and primary pocket layer between adjacent vertically-oriented attachment regions define primary secure-storage pockets, and wherein spaces between the primary pocket layer and the outer pocket layer between vertically-oriented, outer attachment regions define outer secure-storage pockets.

2. The tool bag according to claim 1, wherein said plurality of vertically-oriented attachment regions are locally reinforced proximate an upper edge of said primary pocket layer.

3. The tool bag according to claim 1, wherein said plurality of vertically-oriented attachment regions are locally reinforced proximate said elastic retention strip.

4. The tool bag according to claim 1, wherein said plurality of vertically-oriented attachment regions attach said reinforcing sheet, said base fabric sheet, said primary pocket layer and said primary retention strip together.

5. The tool bag according to claim 1, comprising two of said secure-storage pockets, said secure storage pockets arranged on opposite faces of a wall of said tool bag.

6. The tool bag according to claim 1, wherein said tool bag further comprises a tool bag body formed from a base with a first endwall attached as a first end region of the base and a second endwall attached at a second end region of the base opposite the first end, and a tool wall extending longitudinally and attached to said first endwall and said second endwall, wherein said tool wall is located intermediate side edges of said base, and said tool wall comprises said plurality of primary secure-storage pockets and said plurality of outer secure-storage pockets.

7. The tool bag according to claim 1 wherein said secure-storage pockets further comprise:

an outer elastic retention strip over said outer pocket layer, said outer elastic retention strip extending horizontally and proximate to an upper edge of said outer pocket layer, wherein said plurality of vertically-oriented, outer attachment regions attach said base fabric sheet, said primary pocket layer, said primary elastic retention strip, said outer pocket layer, and said outer elastic retention strip together, wherein lower edges of said base fabric material, said primary pocket layer and said outer pocket layer are attached together.

8. The tool bag according to claim 7, Wherein said plurality of vertically-oriented, outer attachment regions are locally reinforced proximate an upper edge of said outer pocket layer.

9. The tool bag according to claim 7, wherein said plurality of vertically-oriented, outer attachment regions are locally reinforced proximate said outer elastic retention strip.

10. The tool bag according to claim 7, wherein said plurality of vertically-oriented, outer attachment regions attach said reinforcing sheet, said base fabric sheet, said primary pocket layer, said primary elastic retention strip, said outer pocket layer, and said outer elastic retention strip together.

11. The tool bag according to claim 7, wherein there are fewer of said vertically-oriented, outer attachment regions than there are vertically-oriented attachment regions.

12. The tool hag according to claim 7, wherein said tool hag body comprises a base with a first endwall attached at a first end region of the base and a second endwall attached at a second end region of the base opposite the first end portion;

said tool bag further comprising a tool wall attached to said base, said first endwall, and said second endwall, wherein said tool wall is located intermediate side edges of said base, and said tool well comprises said secure-storage pockets.

13. The tool bag according to claim 7, wherein said secure-storage pocket comprises a plurality of secure-storage pockets, wherein said reinforcing sheet, said base fabric sheet, said primary pocket layer, said primary elastic retention strip, said outer pocket layer, and said outer elastic retention strip are continuous across said plurality of secure-storage pockets.

14. The tool bag according to claim 13, comprising two of said plurality of secure-storage pockets, each of said plurality of secure storage pockets arranged on opposite faces of a wall of said tool bag.

15. The tool bag according to claim 1, further comprising:

said tool bag body formed from a base with a first endwall attached at a first end region of the base and a second endwall attached at a second end region of the base opposite the first end portion;

a first sidewall attached to a first lateral portion of the tool bag body, releasably attached to the first endwall and releasably attached to the second endwall; and a second sidewall attached to a second lateral portion of the tool bag body opposite the first lateral portion, said second sidewall comprising a sidewall section flexibly joined to a cover section, wherein said sidewall section is releasably attached to vertical portions of the first endwall and the second endwall, wherein the removable cover is removably attachable to a top portion of the first and second endwalls.

16. The tool bag according to claim 1, further comprising:

said tool bag body formed from a base with a first endwall attached at a first end region of the base and a second endwall attached at a second end region of the base opposite the first end, and a handle rotatably attached to a first handle opening in an upper portion of the first endwall and a second handle opening in an upper portion of the second endwall, wherein the handle includes first and second base mating end portions within said handle openings and terminating facing an interior of the tool bag body.

17. The tool bag according to claim 16, wherein each base mating end portions comprises an outer positioning device to limit longitudinal movement of the handle and an inner positioning device to limit longitudinal movement, said inner and outer positioning devices arranged on opposite sides of each handle opening, and wherein the inner positioning device comprises a endcap assembly, said endcap assembly comprising a cap and a deformable washer sandwiched between said cap and said flange portion on said inside surface of said endwall, said cap attached to said base mating end portions for adjustable application of pressure against said deformable washer.

18. The tool bag according to claim 1, further comprising:

said tool bag body formed from a base with a first endwall attached at a first end region of the base and a second endwall attached a second end region of the base opposite the first end;

a tool wall attached to said first endwall, and said second endwall; and at least one bracket, each of said at least one brackets comprising two legs extending perpendicular to one another, wherein said first endwall comprises a rigid, stabilizing sheet, wherein said tool wall comprises a rigid, stabilizing member extending longitudinally along the length of the tool bag, wherein a first leg of a first bracket is attached to said first endwall and a second leg of said first bracket is attached to a first end region of said rigid, stabilizing element.

19. The tool bag according to claim 1, wherein said secure-storage pockets further comprise:

a plurality of vertically-oriented, outer attachment regions where said base fabric sheet, said primary pocket layer, said primary elastic retention strip, and said outer pocket layer are attached together, wherein said base fabric material, said primary pocket layer and said outer pocket layer are attached along lower edges of each, and wherein said vertically-oriented, outer attachment regions are separated such that an area between the primary pocket layer and the outer pocket layer between adjacent vertically-oriented, outer attachment regions define an outer secure-storage pocket.

20. The tool bag according to claim 7, wherein the outer elastic, retention strip is positioned above a lower edge of said outer pocket layer and below an upper edge of said outer pocket layer.

* * * * *